US009393785B2

(12) United States Patent
Kinoshita et al.

(10) Patent No.: US 9,393,785 B2
(45) Date of Patent: Jul. 19, 2016

(54) LIQUID EJECTING HEAD AND LIQUID EJECTING APPARATUS

(71) Applicant: SEIKO EPSON CORPORATION, Tokyo (JP)

(72) Inventors: Ryota Kinoshita, Matsumoto (JP); Hiroaki Okui, Azumino (JP); Shunsuke Watanabe, Matsumoto (JP); Hitoshi Yamada, Shiojiri (JP); Tadao Furuta, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 112 days.

(21) Appl. No.: 14/208,819

(22) Filed: Mar. 13, 2014

(65) Prior Publication Data

US 2014/0292936 A1 Oct. 2, 2014

(30) Foreign Application Priority Data

Mar. 27, 2013 (JP) ..... 2013-065814

(51) Int. Cl.
*B41J 2/135* (2006.01)
*B41J 2/14* (2006.01)
*B41J 2/055* (2006.01)

(52) U.S. Cl.
CPC ..... *B41J 2/14233* (2013.01); *B41J 2/055* (2013.01); *B41J 2002/14241* (2013.01); *B41J 2002/14491* (2013.01)

(58) Field of Classification Search
CPC .... B41J 2/14201; B41J 2/14233; B41J 2/055; B41J 2002/14241; B41J 2002/14491; B41J 2/14702; B41J 2/17526; B41J 21/12; B41J 2/14129
USPC ..... 347/70, 50, 58, 68, 71, 72, 65
See application file for complete search history.

(56) References Cited

U.S. PATENT DOCUMENTS

| | | | | |
|---|---|---|---|---|
| 4,881,318 | A * | 11/1989 | Komuro et al. | 29/827 |
| 7,213,911 | B2 * | 5/2007 | Taira | 347/68 |
| 7,286,354 | B2 * | 10/2007 | Sugahara | 361/699 |
| 7,322,678 | B2 * | 1/2008 | Suzuki | 347/50 |
| 7,559,631 | B2 * | 7/2009 | Shimada et al. | 347/64 |
| 7,674,984 | B2 * | 3/2010 | Kubo | 174/254 |
| 7,699,438 | B2 * | 4/2010 | Kubo | 347/50 |
| 7,735,978 | B2 * | 6/2010 | Chikamoto | 347/71 |
| 8,313,175 | B2 * | 11/2012 | Miyata et al. | 347/70 |
| 8,556,387 | B2 * | 10/2013 | Nakashima et al. | 347/50 |
| 8,602,530 | B2 * | 12/2013 | Mizukami et al. | 347/50 |

(Continued)

FOREIGN PATENT DOCUMENTS

JP 2011-167964 9/2011

*Primary Examiner* — Huan Tran
(74) *Attorney, Agent, or Firm* — Workman Nydegger

(57) ABSTRACT

A flexible cable includes a portion that is covered by a solder resist and an exposed portion that is not covered by the solder resist, in which the exposed portion contains a wiring terminal and at least continues to a position closer to an outside than an opening of a wiring member insertion side of a wiring vacant portion in a state in which the wiring terminal portion is connected to an element terminal of a piezoelectric element side and in which the wiring vacant portion is filled with an electrically insulating filling material in a state of covering a joining portion between the element terminal and the wiring terminal within the wiring vacant portion, and in a state in which a protective substrate, which forms the wiring vacant portion by partitioning, and the exposed portion of the flexible cable are not in contact with one another.

8 Claims, 6 Drawing Sheets

(56) References Cited

U.S. PATENT DOCUMENTS 8,757,782 B2 * 6/2014 Watanabe et al. ..... 347/84
8,888,232 B2 * 11/2014 Fukuda ..... 347/29
2004/0183867 A1 * 9/2004 Hirota ..... 347/68
2009/0244128 A1 * 10/2009 Ozawa et al. ..... 347/9
2011/0074883 A1 * 3/2011 Ozawa ..... 347/47
2011/0205312 A1 * 8/2011 Miyata et al. ..... 347/70

* cited by examiner

LIQUID EJECTING HEAD AND LIQUID EJECTING APPARATUS

The present application claims priority to Japanese Patent Application No. 2013-065814 filed on Mar. 27, 2013 which is hereby incorporated by reference in its entirety.

BACKGROUND

1. Technical Field

The present invention relates to a liquid ejecting head such as an ink jet recording head, and to a liquid ejecting apparatus provided with the liquid ejecting head. In particular, the invention relates to a liquid ejecting head provided with a wiring member that includes a wiring terminal corresponding to a pressure generating unit of the liquid ejecting head, and to a liquid ejecting apparatus.

2. Related Art

In regard to a type of liquid ejecting head, which discharges a liquid within a pressure chamber from a nozzle as droplets by subjecting the liquid to pressure fluctuation, there is a liquid ejecting head configured to eject droplets by deforming a piezoelectric element (a type of pressure generating unit) that is joined to a vibration plate. In this liquid ejecting head, the piezoelectric element is driven by applying a drive voltage (a drive pulse) thereto, thereby changing the volume of the pressure chamber, the liquid stored within the pressure chamber is subjected to pressure fluctuation, and droplets are ejected from the nozzle using the pressure fluctuation.

The piezoelectric element is electrically connected to a film-shaped wiring member (hereinafter referred to as a flexible cable), onto which an IC such as a Chip On Film (COF) or a Tape Career Package (TCP) that drives the piezoelectric element is mounted, and a drive voltage is supplied to the piezoelectric element via the flexible cable (for example, refer to JP-A-2011-167964). The piezoelectric element includes a lower electrode film, a piezoelectric layer and an upper electrode film. In general, one of the electrodes (for example, the lower electrode film) is an element-shared electrode, which is shared by a plurality of the piezoelectric elements, and the other electrode (for example, the upper electrode film) is formed from individual element electrodes, which are patterned individually for each of the piezoelectric elements. The piezoelectric layer, which is interposed between the element-shared electrode and the individual element electrode, is a piezo-active portion in which piezoelectric deformation occurs due to the application of a drive voltage between the two electrodes.

The flexible cable described above is configured such that, for example, a control IC, which controls the application of the drive voltage to the piezoelectric element, is mounted on the surface of a base film such as a polyimide. In addition, a wiring pattern and a wiring terminal are formed on the flexible cable, and an insulating solder resist covers the wiring pattern, the control IC and the like except for the wiring terminals provided on both end portions of the flexible cable.

The piezoelectric element described above is accommodated by a member formed from a silicon single crystal substrate referred to as a protective substrate (and alternatively, is also referred to as a sealing plate). The terminal portions of the piezoelectric element are disposed within a wiring vacant portion that is provided in the protective substrate. Furthermore, a first end portion of the flexible cable is inserted through the wiring vacant portion, and the wiring terminal formed on the first end portion is electrically connected to the terminal corresponding to the piezoelectric element.

However, in this type of liquid ejecting head, in order to accommodate the demand for miniaturization, the miniaturization of all the members that configure the liquid ejecting head is also being devised. In regard to the protective substrate described above, which is one of the components, together with the miniaturization, where the flexible cable is inserted through the wiring vacant portion, the wiring vacant portion is a space narrow enough that it is possible to insert the first end portion of the flexible cable therethrough. Furthermore, together with the increase in the number of nozzles and the increase in density, the respective terminals configuring the terminal portion are also arranged at a high density and the interval between the terminals is narrow. Therefore, when the wiring work is performed, it is necessary to precisely join the wiring terminals with the terminals of the piezoelectric elements within a narrow space. In such a case, in a typical flexible cable, the thickness of the solder resist that covers the portions except for the terminals becomes a problem. In other words, the thickness of the solder resist is approximately 0.2 mm, for example. However, when the wiring work is performed in the narrow wiring vacant portion described above, there is a concern that the solder resist will make contact with a member (the protective substrate) that forms the wiring vacant portion by partitioning and that the joining positions of the respective terminals will shift.

In addition, in general, there is variation in the coating range of the solder resist of the flexible cable, and when a portion that is not covered by the solder resist makes contact with the protective substrate, which is formed from a silicon single crystal substrate, there is a concern that this will cause short circuiting due to the protective substrate being conductive.

SUMMARY

An advantage of some aspects of the invention is to provide a liquid ejecting head and a liquid ejecting apparatus, both of which are capable of more reliably and securely connecting the terminals of the wiring member and the terminals of the pressure generating unit while preventing problems such as poor connections and short circuits.

According to an aspect of the invention, there is provided a liquid ejecting head which includes a pressure generating unit to which a drive voltage is applied, thereby subjecting a liquid within a pressure chamber to pressure fluctuation and ejecting the liquid from a nozzle, which communicates with the pressure chamber; a base member which accommodates the pressure generating unit; and a wiring member which supplies the drive voltage to the pressure generating unit, in which a first terminal portion of the pressure generating unit is disposed within a wiring vacant portion provided in the base member and a second terminal portion of one end side of the wiring member is electrically connected to the first terminal portion, in which the wiring member includes a first portion which is covered by an insulating layer and a second portion which is not covered by the insulating layer, in which the second portion contains the second terminal portion and at least continues to a position closer to an outside than an opening of a wiring member insertion side of the wiring vacant portion in a state in which the second terminal portion is connected to the first terminal portion, and in which the wiring vacant portion is filled with an electrically insulating filling material in a state of covering a joining portion between the first terminal portion and the second terminal portion within the wiring vacant portion, and in a state in which the base member and the second portion are not in contact with one another.

According to the configuration described above, in the wiring member, the second portion, which is not covered by the insulating layer, contains the second terminal portion and at least continues to a position closer to the outside than the opening of the wiring member insertion side of the wiring vacant portion in a state in which the second terminal portion is connected to the first terminal portion, that is, the insulating layer is not provided in the range of the wiring vacant portion into which the second portion is inserted. Therefore, in regard to the insertion range, it is possible to reduce the thickness of the second portion by the thickness of the insulating layer. Therefore, it is easy to perform the wiring work in the comparatively narrow wiring vacant portion, and the shifting of the joining positions of the respective terminals due to the insulating layer making contact with the base member that forms the wiring vacant portion by partitioning is suppressed.

In addition, the wiring vacant portion is filled with the electrically insulating filling material in a state of covering the joining portion between the first terminal portion and the second terminal portion within the wiring vacant portion, and in a state in which the base member and the second portion are not in contact with one another. Therefore, in a case in which the orientation of the wiring member is fixed by the filling material and the base member is made from conductive material, short circuiting due to the second portion of the wiring member making contact with the base member is prevented. In addition, since the joining portion between the first terminal portion and the second terminal portion is covered by the filling material and strengthened thereby, the joining portion is more securely connected and the occurrence of poor connections and the like is reduced.

In the configuration described above, it is desirable that the filling material reach the first portion, which is closer to the outside than the opening of the wiring vacant portion, and cover an entirety of the second portion.

According to this configuration, since the entire surface of the second portion is covered by the filling material, it is possible to more reliably prevent short circuiting between the second portion and the base member.

In the configuration described above, a configuration in which the first terminal portion and the second terminal portion are connected to one another using a non-conductive adhesive is favorable.

According to this configuration, there is a case in which a non-conductive adhesive is adopted, which does not easily allow short circuiting between the terminals even in a configuration with a comparatively narrow inter-terminal pitch, but the bond strength thereof is weak in comparison with other adhesives such as a conductive adhesive or solder. In the case in which the non-conductive adhesive is adopted, since the joining portion between the terminals, which is joined using the non-conductive adhesive, is strengthened by the filling material, it is possible to adapt the configuration to accommodate the increase in density of the terminals.

According to the configuration described above, a configuration in which the base member is formed from the silicon single crystal substrate is favorable.

According to this configuration, in a configuration in which the base member is formed from a conductive silicon single crystal substrate, the movement of the wiring member is restricted by the filling material. Therefore, the second portion of the wiring member is suppressed from making contact with the base member, and, as a result, short circuiting between the second portion and the base member is prevented.

Furthermore, the liquid ejecting apparatus of the invention is provided with a liquid ejecting head with one of the configurations described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the invention will be described with reference to the accompanying drawings. Furthermore, the embodiments described below are limited in various ways as a favorable specific example of the invention; however, the scope of the invention is not limited to these modes as long as the description does not particularly limit the invention. In addition, the description hereinafter exemplifies an ink jet recording head (hereinafter simply referred to as a recording head) that is mounted on an ink jet printer (a type of the liquid ejecting apparatus of the invention) as the liquid ejecting head of the invention.

Figure 1:
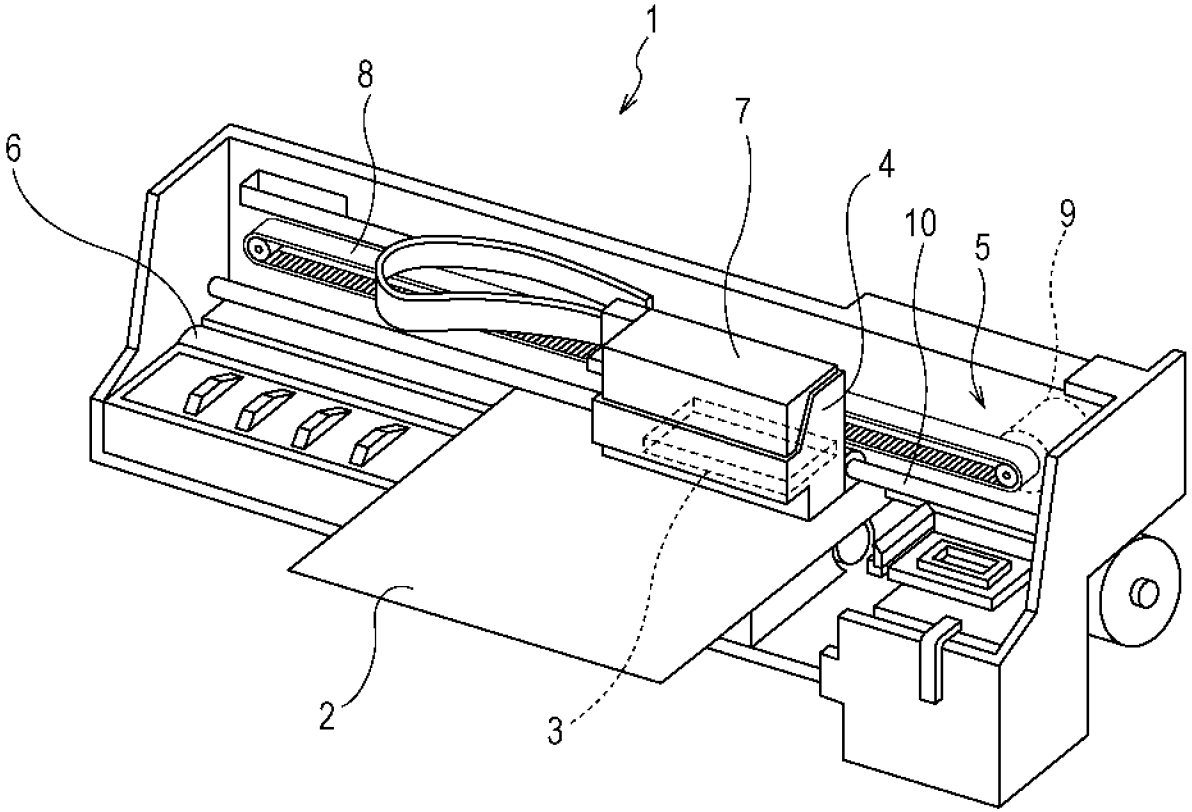
FIG. 1 is a perspective view illustrating the configuration of a printer.

First, the schematic configuration of the printer will be described with reference to FIG. 1. A printer 1 is an apparatus which performs recording of images and the like by ejecting a liquid-form ink onto the surface of a recording medium 2 such as recording paper. The printer 1 is provided with a recording head 3, a carriage 4, a carriage movement mechanism 5, a platen roller 6 and the like. The recording head 3 ejects an ink, the recording head 3 is attached to the carriage 4, the carriage movement mechanism 5 causes the carriage 4 to move in a main scanning direction, and the platen roller 6 transports the recording medium 2 in a sub-scanning direction. Here, the ink described above is a type of the liquid of the invention and is stored in an ink cartridge 7. The ink cartridge 7 is mounted to the recording head 3 in a removable manner. Furthermore, the ink cartridge 7 is disposed on the main body side of the printer 1 and can also adopt a configuration in which the ink is supplied to the recording head 3 through an ink supply tube from the ink cartridge 7.

The carriage movement mechanism 5 described above is provided with a timing belt 8. Furthermore, the timing belt 8 is driven by a pulse motor 9 such as a DC motor. Therefore, when the pulse motor 9 operates, the carriage 4 is guided by a guide rod 10 that is installed across the printer 1 and moves reciprocally in the main scanning direction (the width direction of the recording medium 2).

Figure 2:
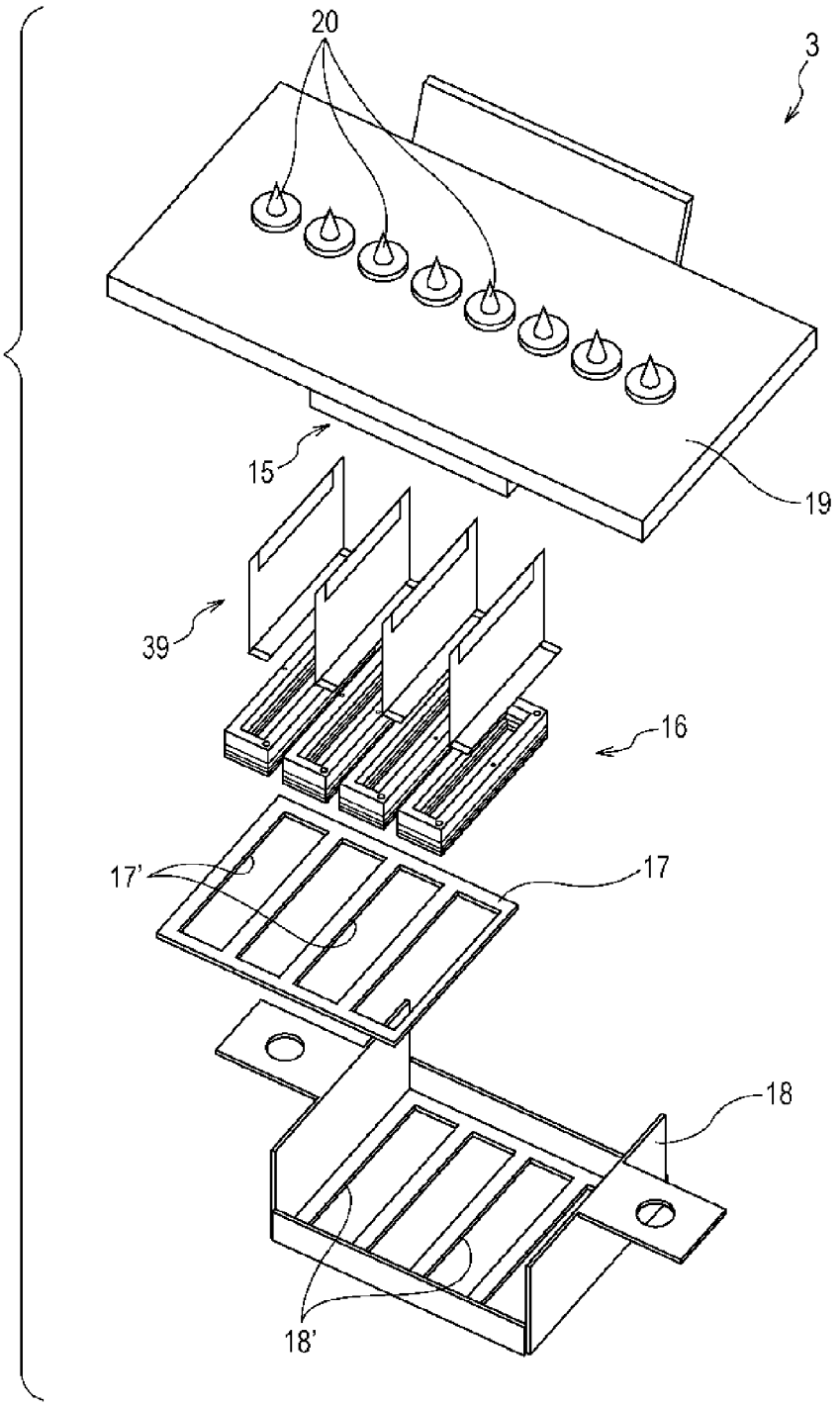
FIG. 2 is an exploded perspective view of a recording head when viewed diagonally from above.

FIG. 2 is an exploded perspective view showing the configuration of the recording head 3. The recording head 3 in this embodiment is substantially configured by a case 15, a plurality of head units 16, a unit fixing plate 17 and a head cover 18.

The case 15 is a box-shaped member that accommodates the head unit 16 and converging flow paths (not shown) in the inner portion thereof, and a needle holder 19 is formed on the upper surface of the case 15. The needle holder 19 is a plate-shaped member for attaching ink introduction needles 20. In this embodiment, eight of the ink introduction needles 20 are arranged on the needle holder 19 to line up horizontally and correspond to the ink colors of the ink cartridge 7. The ink introduction needles 20 are hollow needle-shaped members to be inserted into the ink cartridge 7. The ink introduction needles 20 introduce the ink that is stored in the ink cartridge 7 from introduction pores (not shown) opened in the distal end portions thereof to the head unit 16 side through the converging flow paths within the case 15.

In addition, on the bottom surface side of the case 15, four of the head units 16 are joined with the unit fixing plate 17 and fixed by the head cover 18 in a state of being aligned horizontally in the main scanning direction. The unit fixing plate 17 is made from metal and includes four opening portions 17' that correspond to each of the head units 16, and the head cover 18 is made from metal and is provided with four opening portions 18' that correspond to each of the head units 16 in the same manner.

Figure 3:
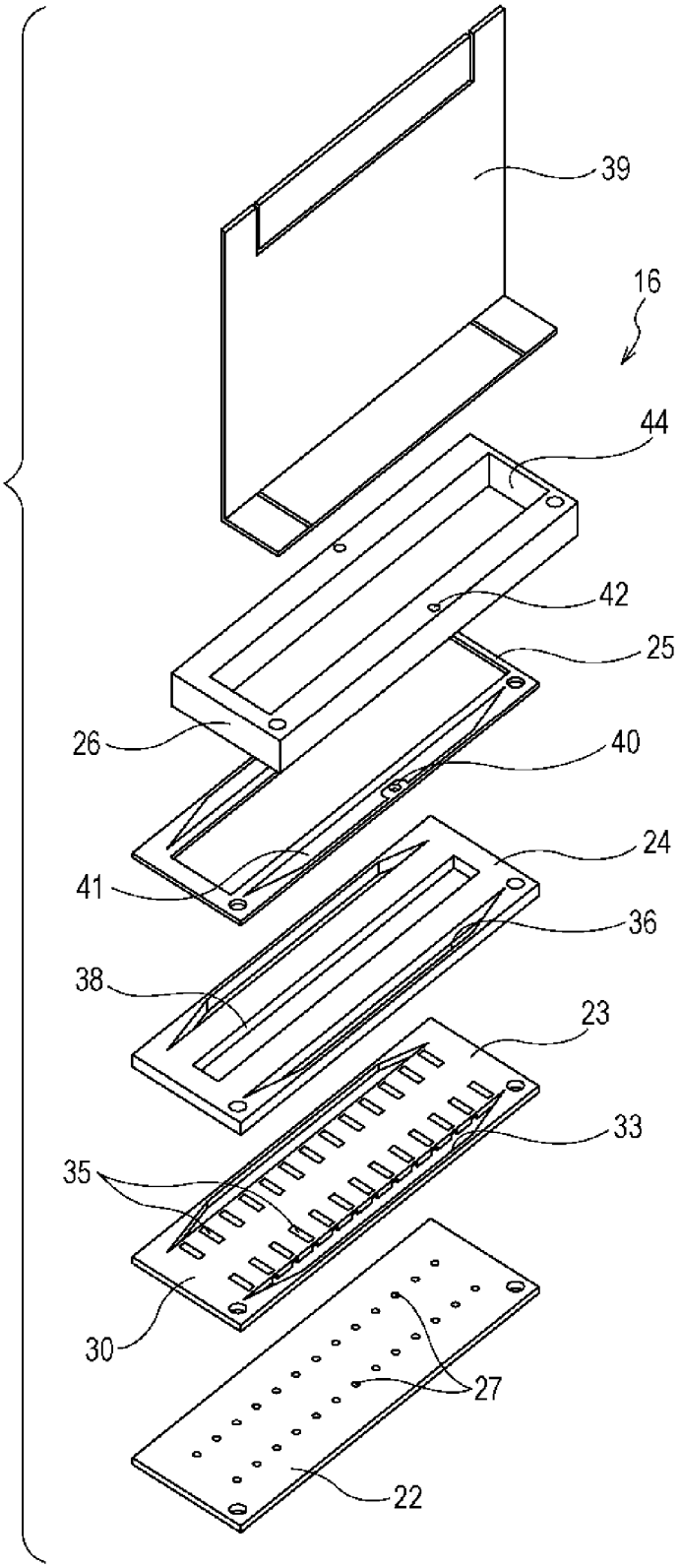
FIG. 3 is an exploded perspective view of a head unit.
Figure 4:
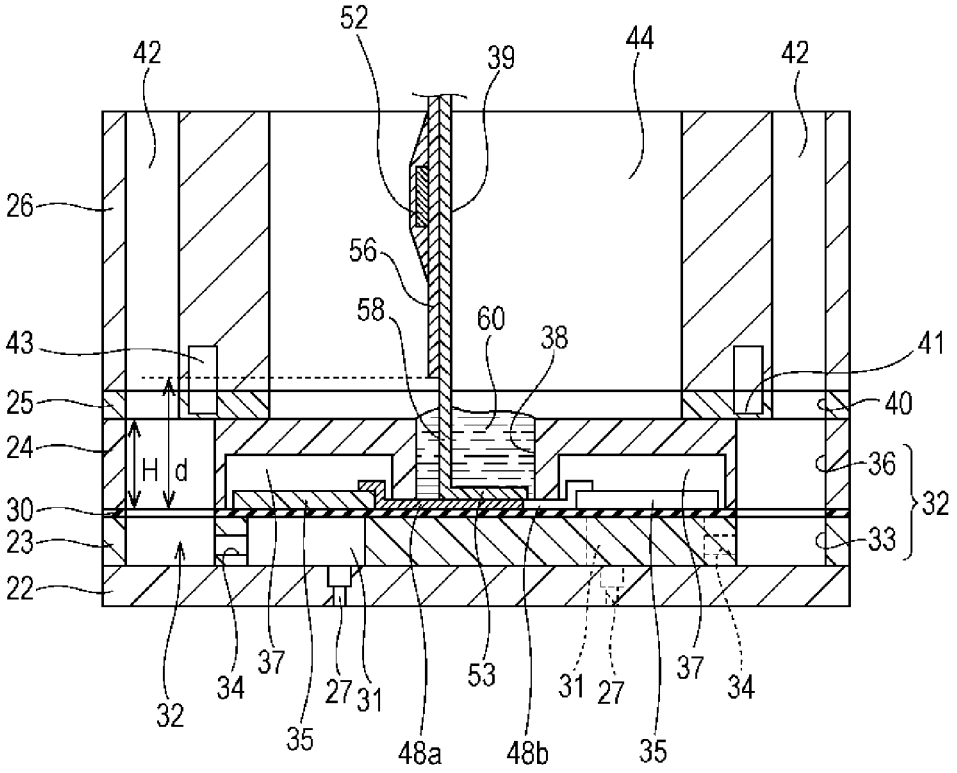
FIG. 4 is a cross sectional view of the head unit.
Figure 5:
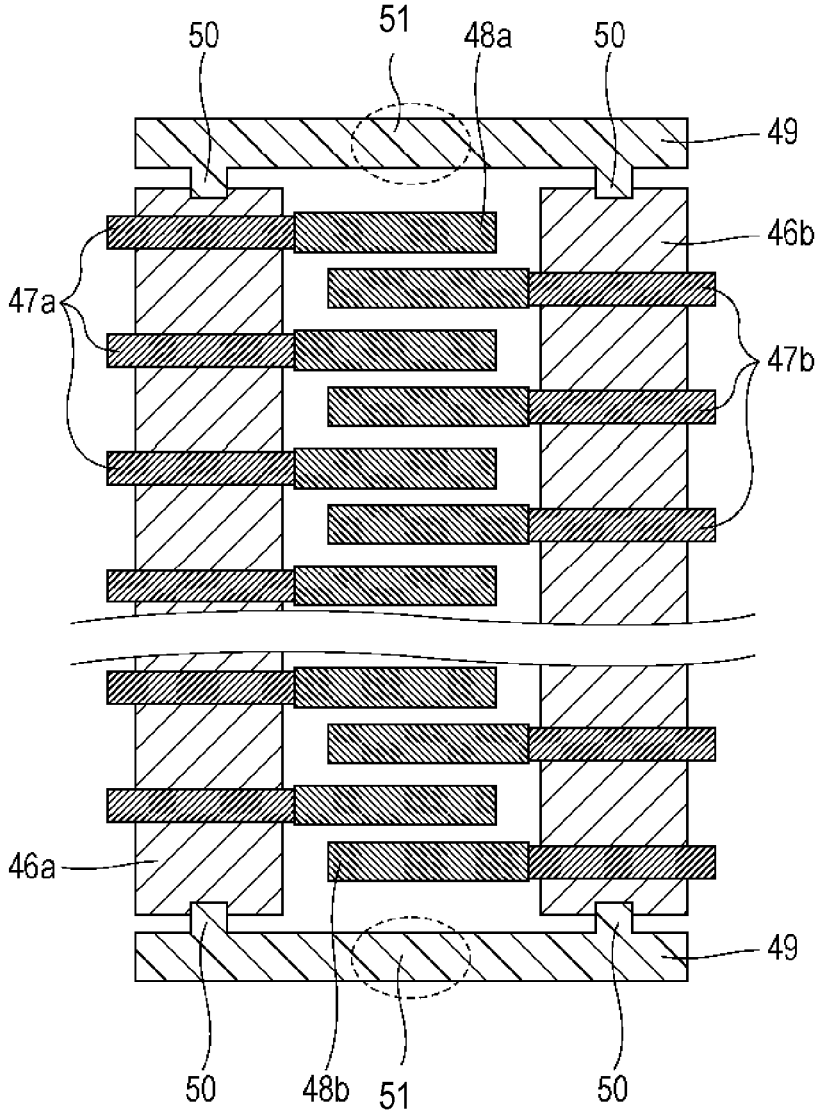
FIG. 5 is a schematic view illustrating the layout of element electrodes of piezoelectric elements and element electrode wiring portions.

FIG. 3 is an exploded perspective view showing the configuration of the head unit 16 (defines the liquid ejecting head more strictly than the recording head 3), and FIG. 4 is a cross sectional view of the head unit 16. Furthermore, for convenience, the lamination direction of all the members will be described as the up-down direction. Furthermore, FIG. 5 is a plan view illustrating the configuration of the element terminal portions of a piezoelectric element 35.

The head unit 16 of this embodiment is configured from a nozzle plate 22, a flow path substrate 23, a protective substrate 24, a compliance substrate 25 and the like. The head unit 16 is attached to a unit case 26 in a state in which the members that configure the head unit 16 are laminated.

The nozzle plate 22 (a type of nozzle forming member) is a plate-shaped member with a plurality of nozzles 27 opened therein in rows at a pitch corresponding to the dot forming density. In this embodiment, a nozzle row (a type of nozzle group) is configured by providing 360 of the nozzles 27 in rows at a pitch corresponding to 360 dpi. In this embodiment, two nozzle rows are formed on the nozzle plate 22.

An extremely thin elastic film 30, which is formed from silicon dioxide, is formed on the upper surface (the surface of the protective substrate 24 side) of the flow path substrate 23 by thermal oxidation. As shown in FIG. 4, a plurality of pressure chambers 31, which are partitioned by a plurality of partition walls formed using anisotropic etching, are formed on the flow path substrate 23 to correspond to each of the nozzles 27. In regard to the flow path substrate 23, a communicating vacant portion 33 that partitions a portion of a common liquid chamber 32 is formed on the outside of the row of the pressure chambers 31. The communicating vacant portion 33 communicates with each of the pressure chambers 31 via ink supply paths 34.

One of the piezoelectric elements 35 (a type of pressure generating unit) is formed for each of the pressure chambers 31 on the elastic film 30 of the upper surface of the flow path substrate 23. The piezoelectric elements 35 are formed by sequentially laminating a lower electrode film (the element-shared electrode 46) made from metal, a piezoelectric layer (not shown) formed from lead zirconate titanate (PZT) or the like and an upper electrode film (an individual element electrode 47) formed from metal. The piezoelectric element 35 is a so-called flexural mode piezoelectric element and is formed so as to cover the upper portion of the pressure chamber 31. In this embodiment, two rows of the piezoelectric elements corresponding to the two nozzle rows are provided to line up in a direction orthogonal to the nozzle rows in a state in which the piezoelectric elements 35 alternate when viewed from the nozzle row direction. Furthermore, it is also possible to adopt a configuration in which the lower electrode film is the individual element electrode 47 and the upper electrode film is an element-shared electrode 46.

Electrode wiring portions (the terminal portions) 48 and 49 respectively extend from each of the element electrodes 47 and 46 of the piezoelectric element 35 into a central region between each of the piezoelectric element rows on the elastic film 30 (refer to FIG. 5). A first end side wiring terminal 53 (a type of the second terminal portion) of a flexible cable 39 is electrically connected to a portion of the electrode wiring portion which corresponds to the electrode terminal. Furthermore, each of the piezoelectric elements 35 is configured to deform according to the application of a drive voltage between the individual element electrode and the element-shared electrode through the flexible cable 39. In this embodiment, the piezoelectric element 35, which contains the elastic film 30 and each of the electrodes 46 and 47, and the electrode wiring portions 48 and 49 that are electrically connected to each of the electrodes of the piezoelectric element 35 are equivalent to an actuator unit. Furthermore, the details of the electrode wiring portion and the flexible cable 39 will be given below.

The protective substrate 24, which includes a penetrating vacant portion 36 that penetrates in the thickness direction, is disposed on the flow path substrate 23 on which the piezoelectric element 35 is formed. The protective substrate 24 is manufactured using a silicon single crystal substrate in the same manner as the flow path substrate 23 and the nozzle plate 22. In addition, the penetrating vacant portion 36 in the protective substrate 24 communicates with the communicating vacant portion 33 of the flow path substrate 23 to partition a portion of the common liquid chamber 32. In addition, an accommodating vacant portion 37 of a size of a degree which does not impede the driving of the piezoelectric element 35 is formed in the protective substrate 24 in a region that opposes the piezoelectric element 35. Furthermore, in regard to the protective substrate 24, a wiring vacant portion 38 that penetrates the substrate thickness direction is formed between the neighboring piezoelectric element rows. The individual element electrode terminal 48, the element-shared electrode terminal 51 (FIG. 5) and the like of the piezoelectric element 35 are disposed within the wiring vacant portion 38 in plan view. The wiring vacant portion 38 is a vacant portion, which includes a rectangular shaped opening that is long in the nozzle row direction in plan view, and the first end portion of the flexible cable 39 is inserted through the opening portion, thereby being connected to the element electrode terminals of the actuator unit.

An ink introduction path 42, which communicates with an ink introduction port 40, for supplying the ink that is introduced from the ink introduction needle 20 side to the common liquid chamber 32 side is formed in the unit case 26. Furthermore, the unit case 26 is a member in which a concave portion 43, which allows the expansion of a flexible portion 41, is formed in a region opposing the flexible portion 41. A vacant portion 44 that penetrates in the thickness direction is provided in the center portion of the unit case 26, and the flexible cable 39 is inserted through the inside of the vacant portion 44.

Furthermore, the nozzle plate 22, the flow path substrate 23, the protective substrate 24, the compliance substrate 25 and the unit case 26 are joined to one another by being heated in a state in which the components are laminated onto one another with an adhesive, a thermal sealing film or the like disposed therebetween.

The head unit 16 that is configured as described above takes the ink from the ink cartridge 7 from the ink introduction port 40 through the ink introduction path 42 into the common liquid chamber 32 side and fills the ink flow path (a type of liquid flow path) from the common liquid chamber 32 to the nozzle 27 with the ink. Furthermore, the drive voltage from the flexible cable 39 is applied to the piezoelectric element 35, causing the piezoelectric element 35 to deform by bending; thereby subjecting the ink within the corresponding pressure chamber 31 to pressure fluctuation and causing the ink to be ejected from the nozzle 27 using the pressure fluctuation of the ink.

FIG. 5 is a schematic view illustrating the layout of the element electrodes of the piezoelectric elements 35 and the element electrode wiring portions that extend from the element electrodes. Furthermore, in FIG. 5, portions shaded with heavy hatching are the individual element electrodes 47 and the individual element electrode wiring portions 48 that are electrically connected thereto, and portions shaded with light hatching are the element-shared electrodes 46 and the element-shared electrode portions 49 that are electrically connected thereto. In addition, in FIG. 5, the vertical direction is the nozzle row direction (the direction in which the piezoelectric elements are provided to line up in a row), and a configuration corresponding to two rows worth of nozzles is illustrated. In this embodiment, platinum or gold is used as the material of the electrode film.

In this embodiment, the element-shared electrodes 46 (46*a* and 46*b*), which are shared by all of the piezoelectric elements 35, are continuously formed on the elastic film 30, which partitions a portion of the pressure chamber 31, in a rectangular shape (in plan view) that is long in the same direction along the nozzle row direction. In addition, the piezoelectric layer (not shown) and the individual element electrodes 47 (47*a* and 47*b*) are sequentially laminated onto the element-shared electrodes 46, and patterning is performed for each of the piezoelectric elements 35. The dimension of the longitudinal direction of the individual element electrode 47 is longer than the width of the short direction of the element-shared electrode 46. In addition, the dimension of the width direction (the short direction) of the individual element electrode 47 is matched to substantially the same as that of the width of the piezoelectric element 35. The individual element electrode terminals 48 (a type of the first terminal portion), which are a strip shape (in plan view) and are electrically connected to the electrodes 47 corresponding to each of the individual element electrodes 47, are provided between neighboring nozzle rows. The dimension of the long direction of the individual element electrode terminal 48 is set to a length at which the individual element electrode terminal 48 does not make contact with the neighboring element-shared electrode 46. In addition, the dimension of the width direction (the short direction) of the individual element electrode terminal 48 is matched to the dimension of the width of the individual element electrode 47. Furthermore, the individual element electrode terminals 48*a* that correspond to the nozzle row of one side (the left side in FIG. 5) and the individual element electrode terminals 48*b* that correspond to the nozzle row of the other side (the right side in FIG. 5) are disposed in row form at a fixed interval so as to line up alternately in the nozzle row direction.

In addition, the element-shared electrode portions 49 are respectively formed on both sides of the nozzle row direction of each of the element-shared electrodes 46*a* and 46*b*. The element-shared electrode portions 49 extend across each of the element-shared electrodes 46*a* and 46*b*, which correspond to each of the nozzle rows, along a direction that intersects the nozzle row direction, and are electrode wiring portions that are shared by the element-shared electrodes 46*a* and 46*b*. In addition, the element-shared electrode portions 49 are electrically connected to each of the element-shared electrodes 46 through branch electrode portions 50. In addition, in regard to the element-shared electrode portions 49, portions that are positioned on both sides in the direction in which the individual element electrode terminals 48 are provided to line up in a row, that is, the portions that are surrounded by circular dotted lines in FIG. 5, are the element-shared electrode terminals (a type of first terminal portion), which are joined with the first end side wiring terminal 53 of the flexible cable 39.

Figure 6:
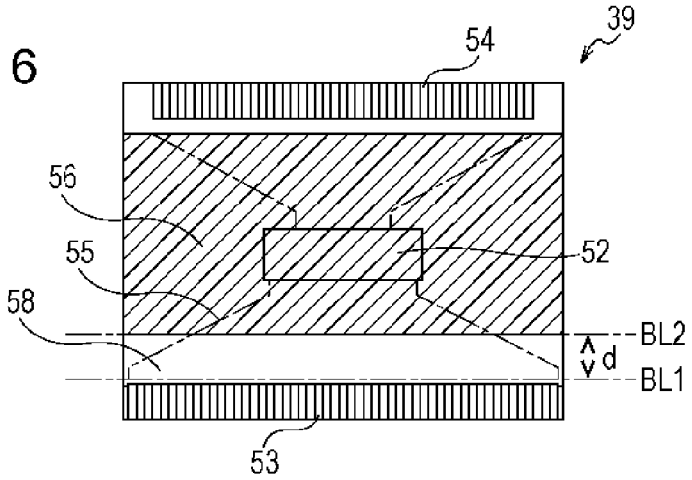
FIG. 6 is a front view illustrating the configuration of a flexible cable.
Figure 7:
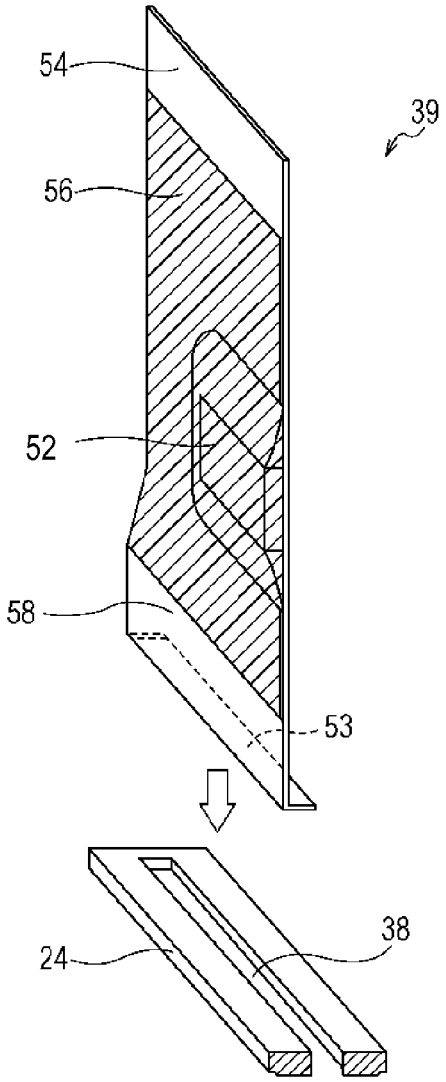
FIG. 7 is a perspective view illustrating the configuration of the flexible cable.

FIG. 6 is a front view illustrating the configuration of the flexible cable 39 (a type of the wiring member in the invention), and FIG. 7 is a perspective view illustrating the configuration of the flexible cable 39. The flexible cable 39 according to the invention is configured such that a control IC 52, which controls the application of the drive voltage to the piezoelectric element 35, is mounted on one surface of a rectangular base film such as a polyimide. In addition, the pattern of electrode wiring 55 connected to the control IC 52 is formed on the flexible cable 39. In addition, a plurality of the first end side wiring terminals 53 are provided to line up in a row corresponding to each of the element electrode terminals 48 and 51 of the actuator unit on the first end portion (the lower end portion in FIG. 6) of the flexible cable 39. A plurality of second end side wiring terminals 54, which are connected to the substrate terminal portions of the substrate (not shown) that relays a signal from the printer main body side, are provided to line up in a row on the second end portion (the upper end portion in FIG. 6) of the flexible cable 39. Furthermore, in regard to the flexible cable 39, the surface of the wiring pattern, the control IC 52 and the like except for the wiring terminals 53 and 54 is covered with a solder resist 56 (equivalent to the insulating layer in the invention). The portion that is covered with the solder resist 56 is equivalent to the first portion in the invention. The solder resist 56 is a coating film formed from an insulating resin. Furthermore, the portions shaded with hatching in FIGS. 6 and 7 indicate the range that is covered with the solder resist 56.

When the wiring work to the actuator unit is performed, the first end portion of the flexible cable 39 is in a state of being folded from a bend line BL1 substantially perpendicular to another surface side of the opposite side from one side on which the wiring terminal, the wiring pattern and the like are formed (refer to FIGS. 3, 4 and 7). The bend line BL1 is virtually set between a wiring terminal forming region and a wiring pattern forming region (refer to FIG. 6). In this state, the portion on which the first end side wiring terminal 53 is formed opposes each of the element electrode terminals 48 and 51 of the actuator unit side when attaching the flexible cable 39 to the actuator unit. The first end side wiring terminal 53 of the flexible cable 39 and the corresponding element electrode terminals 48 and 51 of the actuator unit side are electrically connected to one another by, for example, a non-conductive adhesive (a Non-Conductive Paste: NCP), or non-conductive adhesive formed into a sheet. The flexible cable 39 is attached to the actuator unit. Since the non-conductive adhesive does not contain conductive particles, even in a configuration in which the interval between neighboring terminals is comparatively narrow, it is possible to join the element side terminals with the wiring side terminals while preventing short circuiting between adjacent terminals.

Therefore, it is possible to adapt the configuration to accommodate the increase in density of the terminals. The first end portion of the flexible cable 39 is inserted through the vacant portion 44 of the unit case 26 and the wiring vacant portion 38 of the protective substrate 24, and the first end side wiring terminal 53 is connected to the corresponding element electrode terminals 48 and 51 of the actuator unit side.

Here, in order to accommodate the demands for miniaturization in the recording head 3 of this embodiment, the miniaturization of each of the head units 16 is also devised. Therefore, the miniaturization of all the members that configure the head unit 16 is devised. In regard to the protective substrate 24, which is one of the components, together with the miniaturization, where the flexible cable 39 is inserted through the wiring vacant portion 38, the wiring vacant portion 38 is as narrow a space as possible while still allowing the insertion of the first end portion of the flexible cable 39 therethrough. Furthermore, together with the increase in the number of nozzles and the increase in density, the respective terminals configuring the terminal portion are also arranged at a high density and the interval between the terminals is narrow. Therefore, when the wiring work is performed, it is necessary to precisely join the wiring terminal 53 with the element electrode terminals 48 and 51 within a narrow space. In such a case, in a typical flexible cable such as a COF, the thickness of the solder resist that covers the portions except for the terminals influences the ease of the wiring work and the like. In other words, the thickness of the solder resist is approximately 0.2 mm, for example. However, when the wiring work is performed in the comparatively narrow wiring vacant portion described above, there is a concern that the solder resist will make contact with a member (the protective substrate 24 in this embodiment) that forms the wiring vacant portion by partitioning and that the joining positions of the respective terminals will shift.

In consideration of the points described above, in the recording head 3 according to the invention, an exposed portion 58 (equivalent to the second portion in the invention) that is not covered by the solder resist 56 is provided over a range including the first end side wiring terminal 53 of the flexible cable 39. The exposed portion 58 is provided in a position that is at least closer to the outside than the opening (the opening of the side into which the flexible cable is inserted) in the upper portion of the wiring vacant portion 38 in the protective substrate 24 in a state in which the first end side wiring terminal 53 is connected to the element electrode terminals 48 and 51. In other words, the boundary line (BL2 in FIG. 6) between the exposed portion 58 and the solder resist 56 is configured to be positioned closer to the outside (the second end side of the flexible cable) than the opening in the upper portion of the wiring vacant portion 38 in the protective substrate 24. More specifically, a distance d from the bend line BL1 of the first side of the flexible cable 39 to the boundary line BL2 between the exposed portion 58 and the solder resist 56 is set to be longer than a height H (refer to FIG. 4) of the protective substrate 24 with consideration to coating variation of the solder resist 56. According to this configuration, since the solder resist 56 is not provided in a range of the flexible cable 39 that is inserted into the wiring vacant portion 38, it is possible to reduce the thickness of the insertion range. Accordingly, it is easy to perform the wiring work in the comparatively narrow wiring vacant portion 38, and the shifting of the joining positions of the respective terminals due to the solder resist 39 making contact with a member (the protective substrate 24) that forms the wiring vacant portion by partitioning is suppressed.

However, when the piezoelectric element 35 is actually driven, when the exposed portion 58 of the flexible cable 39 makes contact with the conductive protective substrate 24, there is a likelihood that short circuiting will occur therebetween. Therefore, in the recording head 3 according to the invention, the wiring vacant portion 38 is filled with an insulating filling material 60 in a state of covering at least a joining portion between the first end side wiring terminal 53 and the element electrode terminals 48 and 51 within the wiring vacant portion 38, and in a state in which the protective substrate 24 and the exposed portion 58 are not in contact with one another. In this embodiment, the entire inner portion of the wiring vacant portion 38 is filled up with the filling material 60. A non-conductive resin such as an adhesive is used as the filling material 60. Since the orientation of the flexible cable 39 is fixed by the filling material 60, short circuiting caused by the exposed portion 58 of the flexible cable 39 making contact with the protective substrate 24, which is formed from a silicon single crystal substrate, is prevented. In addition, since the joining portion between the first end side wiring terminal 53 and the element electrode terminals 48 and 51 is covered by the filling material 60 and strengthened thereby, the occurrence of poor connections and the like is reduced. Furthermore, in order to more reliably prevent short circuiting between the exposed portion 58 and the protective substrate 24, it is desirable that the filling material 60 be caused to protrude further upward (the second end portion side of the flexible cable 39) than the opening of the wiring vacant portion 38 to reach the solder resist 56 such that the entirety of the exposed portion 58 be covered by the filling material 60.

Furthermore, in this embodiment, the piezoelectric element 35 is exemplified as the pressure generating unit according to the invention; however, the invention is not limited thereto. For example, the invention is also favorable in a configuration in which the terminal portion of another actuator such as a heating element or a static electricity actuator is joined with the wiring terminal portion.

In addition, description is given above exemplifying the ink jet recording head 3, which is a type of the liquid ejecting head. However, the invention can also be applied to another liquid ejecting head with a configuration in which the wiring terminal of a wiring member and the element terminal of the pressure generating unit are wired to one another within the wiring vacant portion that is surrounded by a conductive structure. For example, the invention can be applied to a color material ejecting head, which is used in the manufacture of color filters of liquid crystal displays and the like, an electrode material ejecting head, which is used in the electrode formation of organic Electro Luminescence (EL) displays, Field Emission Displays (FED) and the like, and a biogenic and organic matter ejecting head, which is used in the manufacture of biochips (biochemical elements).

What is claimed is:

1. A liquid ejecting head, comprising:

a pressure generating unit to which a drive voltage is applied, thereby subjecting a liquid within a pressure chamber to pressure fluctuation and ejecting the liquid from a nozzle, which communicates with the pressure chamber;

a base member which accommodates the pressure generating unit; and a wiring member which supplies the drive voltage to the pressure generating unit, wherein a first terminal portion of the pressure generating unit is disposed within a wiring vacant portion defined by the base member and a second terminal portion of one end side of the wiring member is electrically connected to the first terminal portion, wherein the wiring member includes a first portion which is covered by an insulating layer and a second portion which is not covered by the insulating layer, wherein the second portion contains the second terminal portion, wherein a distance between the second terminal portion and a boundary of the first portion covered by the insulating layer is set to be longer than the height of the base portion that defines the wiring vacant portion, in a state in which the second terminal portion is connected to the first terminal portion, and wherein the wiring vacant portion is filled with an electrically insulating filling material in a state of covering a joining portion between the first terminal portion and the second terminal portion within the wiring vacant portion, and in a state in which the base member and the second portion are not in contact with one another.

2. The liquid ejecting head according to claim 1, wherein the filling material reaches the first portion, which is closer to the outside than the opening of the wiring vacant portion, and covers an entirety of the second portion.

3. The liquid ejecting head according to claim 1, wherein the first terminal portion and the second terminal portion are connected to one another using a non-conductive adhesive.

4. The liquid ejecting head according to claim 1, wherein the base member is formed from a silicon single crystal substrate.

5. A liquid ejecting apparatus, comprising the liquid ejecting head according to claim 1.

6. A liquid ejecting apparatus, comprising the liquid ejecting head according to claim 2.

7. A liquid ejecting apparatus, comprising the liquid ejecting head according to claim 3.

8. A liquid ejecting apparatus, comprising the liquid ejecting head according to claim 4.

* * * * *